US006993279B2

(12) United States Patent
Fukuzawa et al.

(10) Patent No.: US 6,993,279 B2
(45) Date of Patent: Jan. 31, 2006

(54) IMAGE HEATING APPARATUS HAVING A FLEXIBLE SLEEVE

(75) Inventors: Daizo Fukuzawa, Shizuoka (JP); Nobuya Tamura, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 43 days.

(21) Appl. No.: 10/800,777

(22) Filed: Mar. 16, 2004

(65) Prior Publication Data

US 2004/0218949 A1 Nov. 4, 2004

(30) Foreign Application Priority Data

Mar. 18, 2003 (JP) ..... 2003-072900

(51) Int. Cl.
*G03G 15/20* (2006.01)

(52) U.S. Cl. ..... 399/329

(58) Field of Classification Search ..... 399/328, 399/329; 219/216, 388
See application file for complete search history.

(56) References Cited

U.S. PATENT DOCUMENTS

| | | | | |
|---|---|---|---|---|
| 5,083,168 | A | 1/1992 | Kusaka et al. | 355/285 |
| 5,148,226 | A | 9/1992 | Setoriyama et al. | 355/290 |
| 5,149,941 | A | 9/1992 | Hirabayashi et al. | 219/216 |
| 5,210,579 | A | 5/1993 | Setoriyama et al. | 355/285 |
| 5,300,997 | A | 4/1994 | Hirabayashi et al. | 355/285 |
| 5,343,280 | A | 8/1994 | Hirabayashi et al. | 355/285 |
| 5,365,314 | A | 11/1994 | Okuda et al. | |
| 5,444,521 | A | 8/1995 | Tomoyuki et al. | 355/285 |
| 5,464,964 | A | 11/1995 | Okuda et al. | 219/497 |
| 5,525,775 | A | 6/1996 | Setoriyama et al. | 219/216 |
| 5,552,582 | A | 9/1996 | Abe et al. | 219/619 |
| 5,552,874 | A | 9/1996 | Ohtsuka et al. | 355/285 |
| 5,592,276 | A | 1/1997 | Ohtsuka et al. | 339/335 |
| 5,742,878 | A | 4/1998 | Kuroda | 399/122 |
| 5,767,484 | A | 6/1998 | Hirabayashi et al. | 219/216 |
| 5,801,360 | A | 9/1998 | Oba et al. | 219/216 |
| 5,852,763 | A | 12/1998 | Okuda et al. | 399/329 |
| 6,151,462 | A | 11/2000 | Fukuzawa et al. | 399/67 |
| 6,175,699 | B1 | 1/2001 | Kato et al. | 399/69 |
| 6,272,311 | B1 * | 8/2001 | Baughman et al. | 399/341 |
| 6,324,366 | B1 * | 11/2001 | Funayama et al. | 399/159 |
| 6,526,251 | B1 | 2/2003 | Otsuka et al. | 399/313 |
| 6,639,195 | B2 * | 10/2003 | Abe et al. | 399/328 |
| 6,670,044 | B2 | 12/2003 | Shida et al. | 428/458 |
| 2002/0034621 | A1 | 3/2002 | Shida et al. | 428/216 |
| 2003/0170054 | A1 * | 9/2003 | Suzuki et al. | 399/328 |
| 2003/0206756 | A1 * | 11/2003 | Kanamori et al. | 399/328 |

FOREIGN PATENT DOCUMENTS

| | | |
|---|---|---|
| JP | 63-313182 | 12/1988 |
| JP | 2-157878 | 6/1990 |
| JP | 4-44075 | 2/1992 |
| JP | 4-44076 | 2/1992 |

(Continued)

*Primary Examiner*—Christopher W. Fulton
(74) *Attorney, Agent, or Firm*—Fitzpatrick, Cella, Harper & Scinto

(57) ABSTRACT

The image heating apparatus for heating an image formed on a recording material includes a flexible sleeve member, a guide member, a regulating member having a flange portion and a sliding portion, a rotatable member, a nip portion and a plurality of ribs. The plurality of ribs are positioned in the manner the contour of the plurality of ribs is positioned inside the contour of the sliding portion of the regulating member along the longitudinal direction of the image heating apparatus. Thereby, a reduction in the durability of the flexible sleeve member can be suppressed.

5 Claims, 6 Drawing Sheets

FOREIGN PATENT DOCUMENTS

| | | |
|---|---|---|
| JP | 4-44077 | 2/1992 |
| JP | 4-44078 | 2/1992 |
| JP | 4-44079 | 2/1992 |
| JP | 4-44080 | 2/1992 |
| JP | 4-44081 | 2/1992 |
| JP | 4-44082 | 2/1992 |
| JP | 4-204980 | 7/1992 |
| JP | 4-204981 | 7/1992 |
| JP | 4-204982 | 7/1992 |
| JP | 4-204983 | 7/1992 |
| JP | 4-204984 | 7/1992 |
| JP | 6-3982 | 1/1994 |
| JP | 6-282183 | 10/1994 |
| JP | 10-198200 | 7/1998 |
| JP | 10-228192 | 8/1998 |
| JP | 11-231695 | 8/1999 |
| JP | 11-316507 | 11/1999 |
| JP | 2000-194209 | 7/2000 |
| JP | 2001-341231 | 12/2001 |
| JP | 2002-25759 | 1/2002 |
| JP | 2002-134264 | 5/2002 |
| JP | 2002-246151 | 8/2002 |
| JP | 2003-77621 | 3/2003 |

* cited by examiner

IMAGE HEATING APPARATUS HAVING A FLEXIBLE SLEEVE

BACKGROUND OF THE INVENTION

1. Field of the Invention

This invention relates to an image heating apparatus suitable for being mounted as a fixing apparatus in a copying machine or a printer, and particularly to an image heating apparatus having a flexible sleeve.

This apparatus can be used as an image heating and fixing apparatus in an image forming apparatus such as an electrophotographic copying machine, a printer or a facsimile apparatus, i.e., an image heating and fixing apparatus for heating and fixing a toner image formed on transferring paper (such as a transferring material sheet, an electrofax sheet, an electrostatic recording sheet or printing paper) as a permanently secured image by suitable image forming process means such as electrophotography, electrostatic recording or magnetic recording by the use of a toner composed of heat-soluble resin or the like.

Also, this apparatus can be used, for example, as an apparatus for heating transferring paper bearing an image thereon and improving the surface property thereof (lustering or the like), or an apparatus for tentatively fixing an image.

2. Description of Related Art

The image heating apparatus having a flexible sleeve as described above is proposed, for example, in Japanese Patent Application Laid-Open No. 63-313182, Japanese Patent Application Laid-Open No. H2-157878, Japanese Patent Application Laid-Open No. H4-44075, Japanese Patent Application Laid-Open No. H4-204980, etc., and in contrast with other known heating apparatuses or image heating and fixing apparatuses of a heat roller type, a hot plate type, a belt heating type, a flash heating type, an open heating type, etc., it has advantages that i), it can use a low heat capacity linear heating member as a heating member, and thin film of low heat-capacity as film and therefore, the saving of electric power and the shortening of wait time (improvement in quick starting property) become possible and the temperature rise in the interior of the apparatus can be suppressed, that ii) in the image heating and fixing apparatus, a fixing point and a separating point can be set discretely and therefore offset can be prevented, and that various disadvantages peculiar to apparatuses of the other types can be solved, and is an effective apparatus.

FIG. 8 of the accompanying drawings is a side cross-sectional model view of an example (an image heating apparatus) of an image heating apparatus having a flexible sleeve (film), and FIG. 9 of the accompanying drawings is a front cross-sectional model view of the heating apparatus. FIG. 10 of the accompanying drawings is a downward perspective model view of a film guide member 10 which will be described later.

The apparatus of this example is a heating apparatus of a so-called tensionless type film heating type disclosed in Japanese Patent Application Laid-Open Nos. H4-44075 to 44083, Japanese Patent Application Laid-Open Nos. H2-204980 to 204984, etc., and is an apparatus which uses cylindrical endless film as heat-resistant film and in which at least a portion of the circumferential length of this film is always made tension-free (a state not subjected to tension), and the film is adapted to be rotatively driven by the rotative driving force of a pressure roller.

The reference numeral 100 designates a holder for adiabatically supporting a heating member 3, and it also serves as a guide member for the inner surface of the film (hereinafter referred to as the film guide).

The heating member 3 is a linear heating member of low heat capacity long sideways, and is fixedly supported by being fitted into and adhesively secured to a groove 100*a* formed in the outer lower surface of the film guide 100 along the length thereof.

The heating member 3 quickly rises in temperature by an electrical energization heat generating resistance member 4 generating heat over the full length thereof by the electrical energization of this electrical energization heat generating resistance member 4, and the temperature rise is detected by a temperature detecting element 6 and is fed back to a control system, not shown, and the electrical energization of the heat generating resistance member 4 is controlled so that the temperature of the temperature detecting element 6 may be maintained at a predetermined set temperature during image heating.

The reference numeral 2 denotes cylindrical heat-resistant film fitted on the film guide 100 holding the heating member 3, and it is loosely fitted on the film guide 100 with a surplus of the circumferential length thereof.

The reference numerical 70 designates regulating members disposed as film draw movement regulating means on the left and right end portions of the film guide 100 for receiving the end portions of the film.

The reference numeral 8 denotes a pressure roller for forming a pressure contact nip portion (fixing nip portion) N with the film 2 interposed between it and the heating member 3, and rotatively driving the film 2, and it has a metal shaft 8*a* and a heat resisting rubber layer 8*b* of silicon rubber or the like good in mold releasing ability. A metallic stay 15 is provided on the film guide 100, and pressure springs 13 are disposed between an apparatus frame 12 and the stay 15 to thereby apply predetermined pressure to the nip portion N.

A rotative driving force is transmitted to the pressure roller by driving means M through a motive power transmitting system, not shown, whereby the pressure roller is rotatively driven in a counter-clockwise direction indicated by arrow.

A rotating force acts on the film 2 by the frictional force between the pressure roller and the outer surface of the film by the rotative driving of the pressure roller 8 (when a material P to be heated is introduced into the pressure contact nip portion N, a rotating force indirectly acts on the film 2 through the material P to be heated), and the film 2 is rotatively driven in a clockwise direction a indicated by arrow while sliding in pressure contact with the surface of the heating member 3. The film guide 100 facilitates the rotation of this film 2.

On the basis of a print command signal or on the basis of a signal when the leading edge of the material P to be heated bearing thereon an unfixed visible image (toner image) to be fixed is detected by a sensor (not shown) disposed on this side of the apparatus, the rotative driving of the pressure roller 8 is started and the temperature rise of the heating member 3 is started.

In a state in which the rotating peripheral speed of the film 2 by the rotation of the pressure roller 8 has become steady and the temperature of the heating member 3 has risen to a predetermined level, a recording material P as the material to be heated having thereof an image to be fixed is introduced into between the film 2 and the pressure roller 8 in the fixing nip portion N and is nipped and transported through the fixing nip portion N with the film 2, whereby the heat of the heating member 3 is imparted to the recording material P through the film 2 and the unfixed visible image T on the recording material P is heated and fixed on the surface of the recording material P. The recording material P passed through the fixing nip portion N is separated from the surface of the film 2 and is transported.

In the apparatus of such a tensionless type film heating type, during the rotatively driven state of the film, tension acts only the fixing nip portion N and a contact portion area between the outer surface portion of the film guide upstream of the fixing nip portion N with respect to the direction of rotation of the film and the film, and tension does not act on the most of the remaining portion of the film.

Therefore, the draw moving force of the film 2 along the length of the film guide during the rotatively driven state of the film is small, and the film draw movement regulating means or film draw controlling means can be simplified. For example, the film draw movement regulating means can be made into a simple one like a regulating member 70 having a flange 70*a* for receiving an end portion of the film, and the film draw controlling means can be omitted to thereby achieve a reduction in the cost and downsizing of the apparatus.

As shown in FIG. 10, a plurality of ribs 110 are provided on the film guide 100 to thereby reduce the area of contact between the film 2 and the film guide 100, thereby decreasing the frictional resistance between the film 2 and the film guide 100, and stabilizing the rotational movement of the film 2.

However, the above-described conventional image heating apparatus having a flexible sleeve has suffered from problems shown below.

The ribs 110 of the film guide 100 stably regulate the rotational moving shape of the film, but if the ribs strongly contact with the film 2, stress is applied to the film in that portion and therefore, there is the possibility of the traces of the ribs uniformly remaining in the circumferential direction of the film, and in the worst case, the film was broken in those portions.

FIG. 6 of the accompanying drawings is a view of the film guide 100 as it is seen from the fixing nip surface side.

As shown in FIG. 6, the ribs 110 are disposed are downstream of the film guide 100 relative to the fixing nip portion with respect to the transport direction of the material to be heated, but during the rotational movement of the film, the film is rotated from an upstream-to-downstream direction and therefore, the film becomes rather tensioned relative to the ribs on the upstream side of the nip portion and becomes rather loosened relative to the ribs on the downstream side of the nip portion. Accordingly, in almost all cases, it is the ribs on the upstream side that injures the film.

Such a phenomenon occurs particularly remarkably in a case where the shapes (contours) of the sliding surfaces 70*b* of the regulating members 70 for regulating the rotatively moving shape of the film relative to the inner surface of the film and the sliding surfaces 10*b* of the ribs 110 relative to the inner surface of the film differ from each other and the contour of the ribs 110 is not inside the contour of the sliding surfaces 70*b* of the regulating members 70, but assumes a shape jutting out to upstream of the contour of the sliding surfaces 70*b* of the regulating member 70.

FIG. 7 of the accompanying drawings shows such a state, and is a cross-sectional view showing construction in which the film 2 and the regulating members 70 are combined with the film guide 100 as it is seen from the fixing nip surface side.

If as shown in FIG. 7, the sliding surfaces of the ribs 110 relative to the inner surface of the film jut out to upstream of the sliding surfaces 70*b* of the regulating members 70 relative to the inner surface of the film, the end portions of the film are regulated to downstream of the ribs by the sliding surfaces 70*b* of the regulating members 70 and therefore, the film becomes very strongly tensioned between the ribs at the lengthwisely opposite ends of the film guide lying at locations nearest to the regulating members and the regulating members. If in such a state, the film is rotatively moved, the film may be injured circumferentially thereof by the frictional contact between the ribs at the opposite ends and the inner surface of the film and finally, the film may be cut at these locations.

Usually, the circumferential lengths of the sliding portions 70*b* of the regulating member relative to the inner surface of the film are set so as to be substantially equal to the inner circumferential length of the film with a very slight clearance so as not to be too loose relative to the inner circumferential length of the film. This is because if the circumferential lengths of the sliding portions of the regulating members relative to the inner surface of the film are extremely smaller than the inner circumferential length of the film, the movement of the film will not be stable and buckling will become liable to occur at the end portions of the film.

Thus, the rotative by moving shape of the film is regulated chiefly by the regulating members at the opposite ends, whereas the portions in which the ribs jut out more than the sliding surfaces 70*b* of the regulating members 70 assume a shape unnaturally jutting out as the film and are subjected to strong stress. Such a phenomenon is more liable to occur as the rotatively moving speed of the film becomes higher and a load to which the film is subjected becomes greater.

Also, if the ribs are thus in strong contact with the film, the ribs will take away the heat of the film and therefore temperature unevenness will occur on the film. That is, the temperature of the portions of the film which are in contact with the ribs will become low and this will intactly provide uneven heating during the heating of the material to be heated at the nip, and during the heating and fixing of an image, uneven luster or faulty fixing will occur at locations corresponding to the ribs.

In the conventional apparatus, the rotative moving speed of the film was relatively low and therefore, such phenomena as the injury of the film and uneven heating did not become remarkable, and in this point of view, it was necessary to take the shapes of the regulating member and the ribs into consideration.

However, in recent years, the tendency of printers, etc. carrying an image heating apparatus of the film heating type thereon toward a higher speed is remarkable and the lives of the apparatuses tend to be required to be longer. Now that the application of such a heating apparatus of the film heating type to a high-speed machine has become strongly required, the necessity of achieving the solution of the above-noted problems has been rising as an important technical task.

SUMMARY OF THE INVENTION

The present invention has been made in view of the above-noted problems and an object thereof is to provide an image heating apparatus which can suppress a reduction in the durability of a flexible sleeve.

Another object of the present invention is to provide an image heating apparatus which can suppress the uneven heating of an image.

Still another object of the present invention is to provide an image heating apparatus having:

a flexible sleeve member;

a guide member for guiding the rotation of the sleeve member, the guide member being disposed in the interior of the sleeve member;

a regulating member for regulating the end portions of the sleeve member, the regulating member having a flange portion opposed to an end surface of the sleeve member, and a sliding portion opposed to the inner peripheral surface of the sleeve member; and a rotatable member contacting with the outer peripheral surface of the sleeve member;

wherein the portion of contact between the sleeve member and the rotatable member is a nip portion for heating an image formed on a recording material, and on at least a portion of the guide member upstream of the nip portion, with respect to the direction of rotation of the sleeve member, there are a plurality of ribs along the direction of the generatrix of the sleeve member, and when the apparatus is viewed from one end side thereof in the longitudinal direction thereof, the contour of the ribs is inside the contour of the sliding portion of the regulating member.

Further objects of the present invention will become apparent from the following detailed description when read with reference to the accompanying drawings.

DETAILED DESCRIPTION OF THE PREFERRED EMBODIMENT (First Embodiment)

Figure 1:
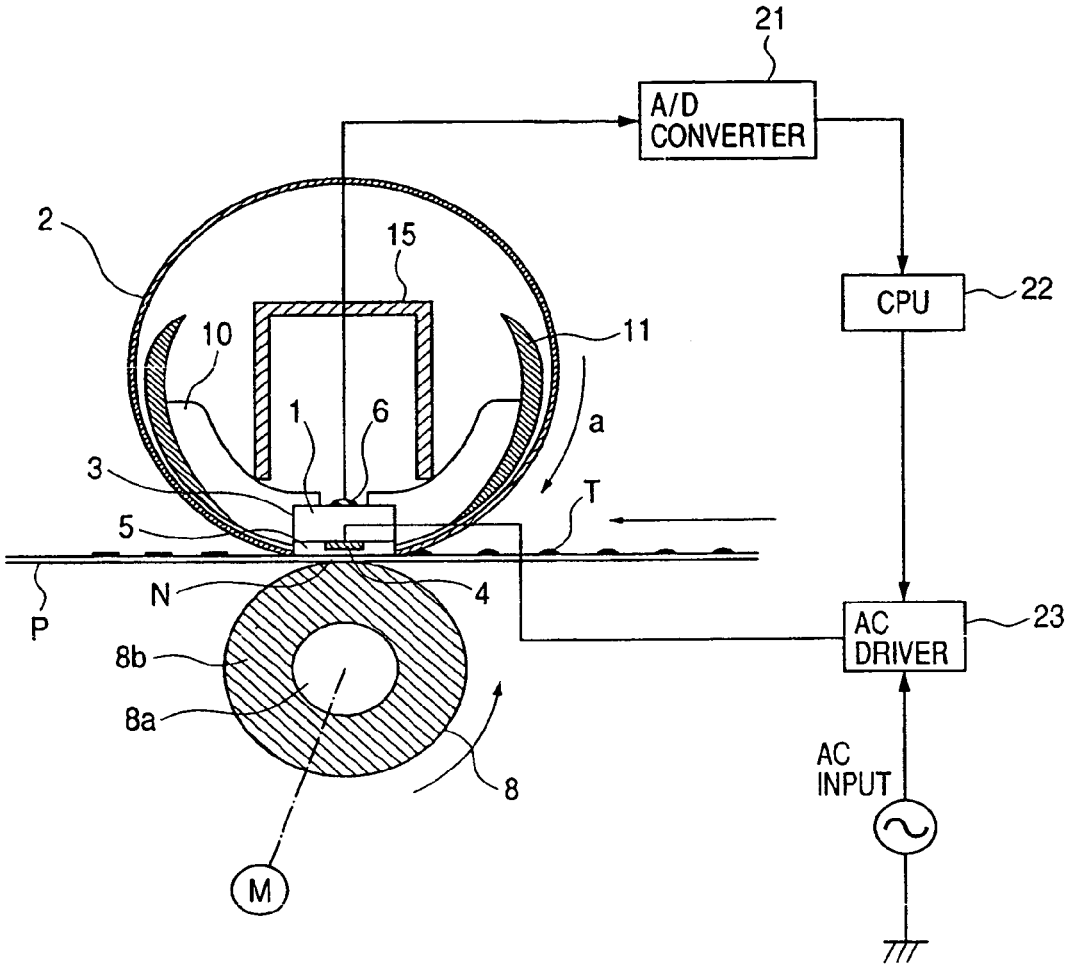
FIG. 1 is a side cross-sectional view of an image heating apparatus according to a first embodiment of the present invention.
Figure 2:
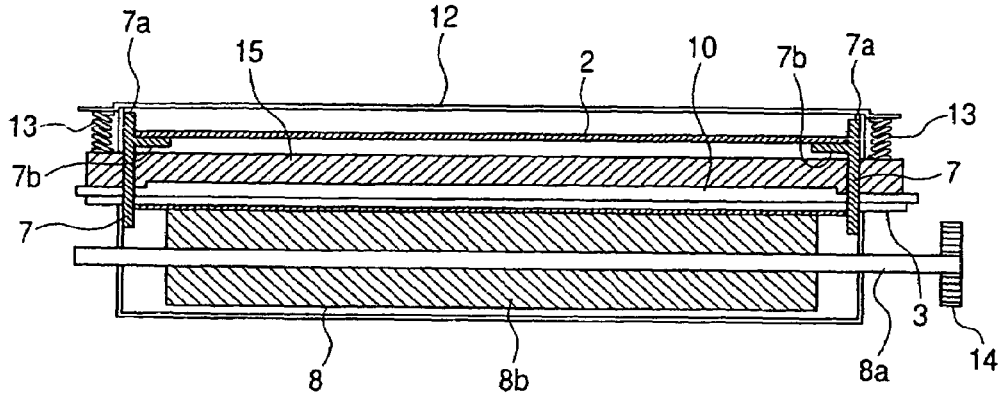
FIG. 2 is a front cross-sectional view of the image heating apparatus according to the first embodiment of the present invention.

FIG. 1 is a side cross-sectional model view of a heating apparatus according to the present embodiment, and FIG. 2 is a front cross-sectional model view of the heating apparatus.

The reference numeral 10 designates a holder for adiabatically supporting a heating member 3 which will be described later, and it is a substantially semicircular trough-shaped member having an upward transverse cross section which is sideways long, and serves also as a guide member (hereinafter referred to as the film guide) for the inner surface of film (flexible sleeve member).

The heating member 3 is a linear heating member of low heat capacity sideways long, and is fixedly supported by being fitted into and adhesively secured to a groove 10*a* formed in the outer lower surface of the film guide 10 along the length thereof.

The reference numeral 2 denotes cylindrical heat-resistant film (flexible sleeve member) fitted on the film guide 10 including the heating member 3. The inner circumferential length of this cylindrical heat-resistant film 2 and the outer circumferential length of the film guide 10 including the heating member 3 are such that the outer inner circumferential length of the film 2 is made greater by e.g. 3 mm, and accordingly the film 2 is loosely fitted on the film guide 10 including the heating member 3 with a surplus of circumferential length.

The reference numeral 7 designates regulating members for receiving the end surfaces of the film 2 and regulating the draw movement of the film 2 when the film 2 is moved in the direction of the generatrix thereof while being rotated. The regulating members 7 are disposed on the lengthwisely opposite ends of the heating apparatus, and are fixed to the left and right end portions of the film guide 10. Each of the regulating members 7 has a flange portion 7*a* for receiving an end surface of the film 2, and a sliding portion (sliding surface) 7*b* opposed to the inner peripheral surface of an end portion of the film 2.

The reference numeral 8 denotes a pressure roller (rotatable member) for a forming a pressure contact nip portion (fixing nip portion) N with the film 2 interposed between it and the heating member 3, and rotatively driving the film 2. This pressure roller 8 has a metal shaft 8*a* and a heat-resisting rubber layer 8*b* of silicon rubber or the like good in mold releasing ability. As shown in FIG. 2, a metallic stay 15 is provided on the film guide 10, and pressure springs 13 are provided between the opposite end portions of the stay 15 and an apparatus frame 12 to thereby apply predetermined pressure (total pressure of 100–140N for a width of e.g. A4) to the nip portion N formed by and between the heating member and the pressure roller 8.

A rotative driving force is transmitted by driving means M through a motive power transmitting system, not shown, whereby the pressure roller 8 is rotatively driven in a counter-clockwise direction indicated by arrow.

A rotating force acts on the film 2 by the frictional force between the outer surface of the pressure roller and the outer surface of the film by this rotative driving of the pressure roller 8 (when a material P to be heated is introduced into the pressure contact nip portion N, a rotating force indirectly acts on the film through the material P to be heated), and the film 2 is rotatively driven in a clockwise direction a indicated by arrow while sliding in pressure contact with the surface of the heating member 3. The film guide 10 facilitates the rotation of this film 2. Also, in order to reduce the sliding resistance between the inner surface of the film 2 and the surface of the heating member 3, it is preferable to interpose a small amount of lubricant such as heat-resistant grease between the two.

The film guide 10 can be constructed of highly heat-resistant resin such as polyphenylene sulfide (PPS), polyamideimide (PAI), polyimide (PI), polyether ether ketone (PEEK) or liquid crystal polymer, or a compound material of these resins and ceramics, a metal, glass or the like.

The heating member 3 is a linear heating member generally of low heat capacity (ceramic heater) comprising an elongate heat-resistant, insulative and highly thermally conductive heater substrate 1 having its length in a direction perpendicular to the transport direction a of the heat-resistant film 2 or a recording material P as the material to be heated, an electrical energization heat generating resistance member 4 formed on the widthwisely central portion of the front side of this substrate along the length of the substrate, an electrode (not shown) for electrically energizing the electrical energization heat generating resistance member, a heat-resistant overcoat layer 5 for protecting the surface of the heating member on which the electrical energization heat generating resistance member is formed, a temperature detecting element 6 such as a thermistor provided on the back side of the substrate for detecting the temperature of the heating member, etc.

The heating member 3 is fixedly disposed on the underside of the heat-resistant and adiabatic film guide 10 as previously described with the front side having the electrical energization heat generating resistance member 4 formed thereon exposed downwardly. The heater substrate 1 is ceramics or the like such as alumina or aluminum nitride having a thickness of 1 mm, a width of 10 mm and a length of 240 mm.

The electrical energization heat generating resistance member 4 is formed by coating an electrical resistance material such as silver palladium (Ag/Pd), $RuO_2$ or $Ta_2N$ into a lineal shape or a thin band-like shape having a thickness of about 10 $\mu$m and a width of 1–3 mm by screen printing or the like.

The electrode for electrical energization is a screen-printed pattern layer of Ag or the like. The overcoat layer 5 is, for example, a heat-resistant glass layer having a thickness of about 10 $\mu$m.

The heating member 3 quickly rises in temperature by the electrical energization heat generating resistance member 4 generating heat over the full length thereof by the electrical energization of the electrode (not shown) of the electrical energization heat generating resistance member 4, and the temperature rise is detected by the temperature detecting element 6, and during image heating, the electrical energization of the heat generating resistance member 4 is controlled so that the temperature of the temperature detecting element 6 may be maintained at a predetermined set temperature. The output signal of the temperature detecting element 6 is inputted to a CPU 22 through an A/D converter 21.

The CPU 22 controls electric power supplied to the heat generating resistance member 4 of the heating member 3 through an AC driver 23, on the basis of this input signal, and controls the temperature of the heating member 3 so as to become a predetermined temperature.

As the control of the heating operation of the heating member 3 by the CPU 22, besides the control of changing over the amplitude or period or the like of an AC bias supplied to the heat generating resistance member 4 in conformity with the detected temperature by the temperature detecting element 6, there is effected the control of adjusting the amount of electrical energization of the heat generating resistance member 4 by an external power source for any predetermined time, i.e., so-called phase control or wave number control.

Particularly, the wave number control has the advantage that the occurrence of noise accompanying electrical energization is small as compared with the phase control and therefore, in the heating apparatus according to the present embodiment, the wave number control is adopted as the control of the heating operation of the heating member 3.

In order to make heat capacity small and improve the quick starting ability, as the film 2, use can be made of single-layer or compound-layer film having heat resistance, mold releasing ability, strength, durability and flexibility and having a film thickness of 100 $\mu$m or less, preferably of 70 $\mu$m or less and 20 $\mu$m or greater. Such film is, for example, single-layer film of PTFE, PFA, FEP or the like, or compound-layer film comprising film of polyimide, polyamide-imide, PEEK, PES, PPS or the like having its outer peripheral surface coated with PTFE, PFA, FEP or the like.

On the basis of a print command signal or on the basis of a signal when the leading edge of the recording material P bearing thereon an unfixed visible image (toner image) T to be fixed and transported from an image forming means portion, not shown, to the image heating apparatus is detected by a sensor (not shown) disposed on this side of the image heating apparatus, the rotative driving of the pressure roller 8 is started and the temperature rise of the heating member 3 is started.

In a state in which the rotational peripheral speed of the film 2 by the rotation of the pressure roller 8 has become steady and the temperature of the heating member 3 has risen to a predetermined temperature, the recording material P to be image-fixed as a material to be heated is introduced into between the film 2 and the pressure roller 8 in the fixing nip portion N and is nipped and transported with the film 2, whereby the heat of the heating member 3 is imparted to the recording material P through the film 2 and the unfixed visible image T on the recording material P is heated and fixed on the surface of the recording material P. The recording material P passed through the fixing nip portion N is separated from the surface of the film 2 and is transported.

Figure 3:
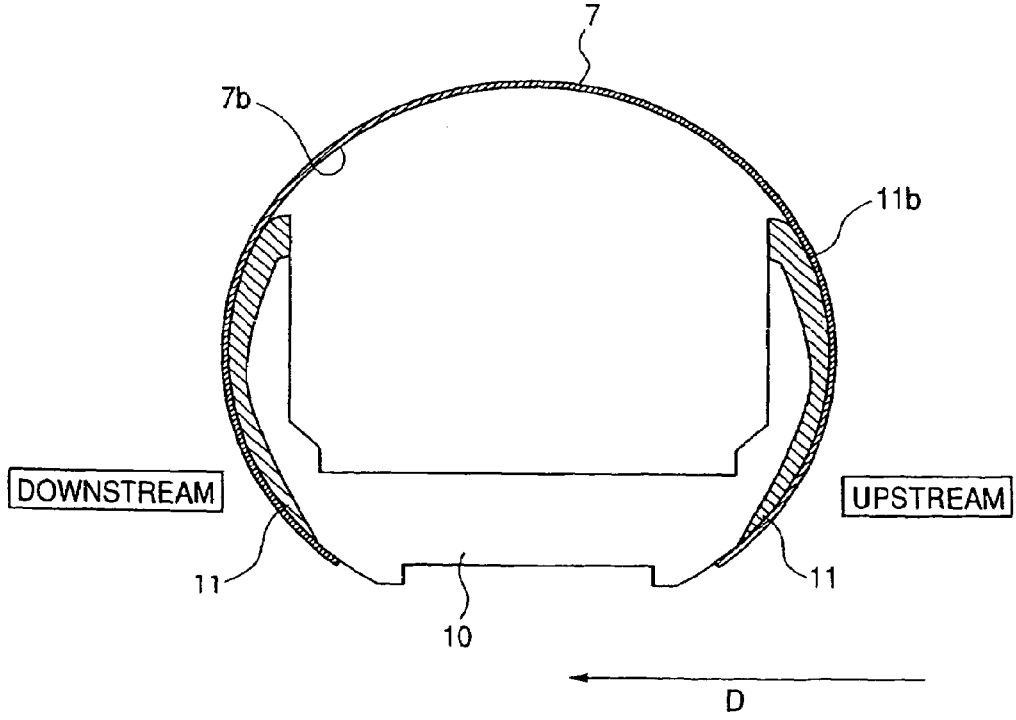
FIG. 3 shows the regulation between the contour of a film guide in the first embodiment of the present invention and the contour of a regulating member for regulating the end portions of film.
Figure 4:
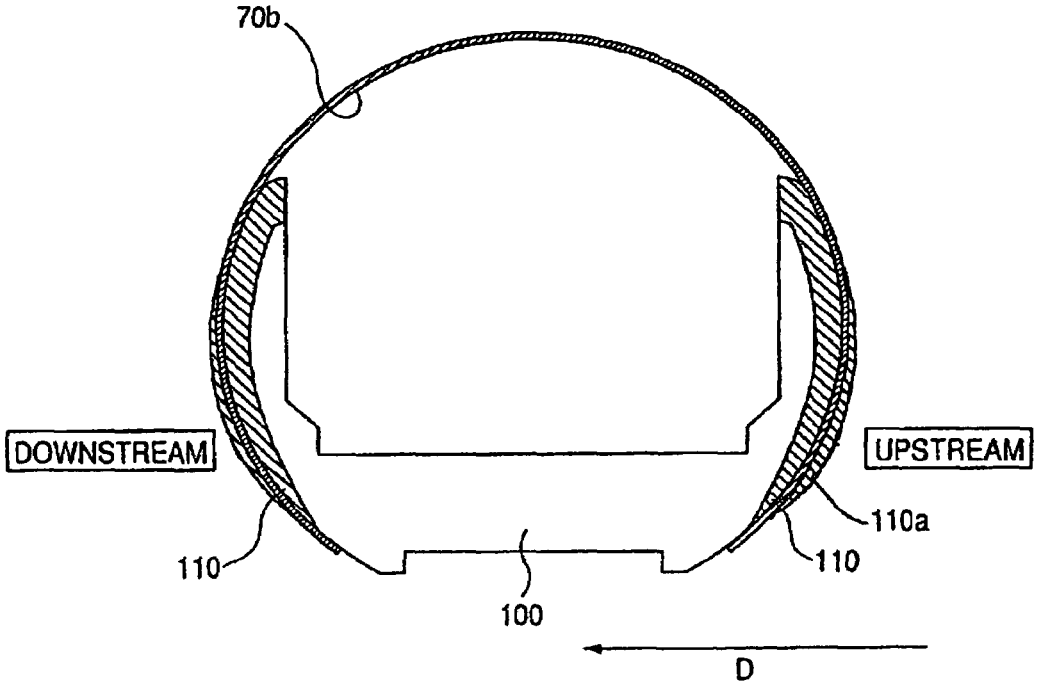
FIG. 4 PRIOR ART
FIG. 4 shows the relation between the contour of the film guide of a conventional apparatus and the contour of a regulating member for regulating the end portions of film.

FIG. 3 is a transverse cross-sectional view showing the dimensions of and the positional relation between the film guide 10 of the image heating apparatus according to the present embodiment and the sliding surface 7*b* of the regulating member for regulating the end portions of the film in overlapped relationship with each other. FIG. 4 is a transverse cross-sectional view showing the dimensions of and the positional relation between the film guide 100 and the sliding surface 70*b* of the regulating member 70 of a conventional image heating apparatus in overlapped relationship with each other.

In these figures, arrow D indicates the transport direction of the recording material, the entering-side of the recording material is upstream and the discharging side is downstream.

In the present embodiment, the dimensions and shapes of ribs 11 and the flanges 7*a* are set such that all of the sliding surfaces 11*b* of the ribs 11 disposed on the film guide 10 relative to the inner surface of the film are more inside relative to the center of rotation of the film than the sliding surface 7*b* of the regulating member 7 relative to the inner surface of the film. In other words, the height of the ribs on the film guide and the size of the sliding portion of the regulating member are set such that when the image heating apparatus is viewed from one end side in the lengthwise direction thereof, the contours of all ribs on the film guide are inside the contour of the sliding surface of the regulating member relative to the film. If such dimensions are adopted, as will be seen from FIG. 3, the cross section assumes such a shape that the sliding portion 7*b* of the regulating member 7 relative to the inner surface of the film fully covers the sliding portion of the rib 11 relative to the inner surface of the film.

In contrast, in the conventional construction shown in FIG. 4, a part of the contour of the rib 110 of the film guide 100 protrudes from the contour of the sliding surface 70*b* of the regulating member 70 relative to the inner surface of the film (see 110*a* in FIG. 4). In such a portion, the film becomes strongly tensioned as previously described, and during the rotation of the film, the rib portion 110*a* and the inner surface of the film may frictionally slide relative to each other to thereby damage the film.

In the construction of the present embodiment, the height of the rib 11 is low (the contour is small) and all the portions of the rib 11 are more inside than the sliding portion 7*b* of the regulating member 7 (the contour of the rib 11 is smaller than the contour of the sliding portion 7*b*) and therefore, there is no location at which as in the prior art, the film is strongly tensioned between the regulating member and the rib and is subjected to stress. Accordingly, the film does not strongly frictionally slide relative to the rib 11, and even if the film is rotated at a high speed, it never happens that the inner surface of the film is injured by the rib or the film is cut by the rib.

In the present embodiment, the height of the ribs 11 is lower than the height of the sliding portion 7*b* of the regulating member 7 relative to the inner surface of the film, but even if the ribs and the sliding portion of the regulating member are of the same height, it is effective for the prevention of the damaging of the film. Accordingly, the contour of the sliding portion 7*b* and the contour of the ribs 11 may be the same, and the contours of all of a plurality of ribs 11 provided along the lengthwise direction of the film guide 10 upstream of at least the nip portion can be inside the contour of the sliding portion 7*b* of the regulating member 7. However, it is more effective to suppress the uneven temperature of the film caused by the film contacting with the ribs that the contact pressure of the film with the ribs upstream of the nip portion N with respect to the direction of rotation of the film is made s small as possible. Preferably the sliding surface of the regulating member relative to the inner surface of the film may be higher by 0.1 mm or more than the sliding surfaces of the ribs relative to the inner surface of the film. In other words, the sliding surface of the regulating member relative to the inner surface of the film may preferably be greater by 0.1 mm or more in contour than the sliding surfaces of the ribs relative to the inner surface of the film.

On the other hand, if the height of the sliding surfaces of the ribs relative to the inner surface of the film is too lower (the contour thereof is too small) than the height of the sliding surface of the regulating member relative to the inner surface of the film, the ribs will become incapable of performing the function of guiding the rotating movement of the film, and on the upstream side, the film will be rotated while being depressed near the center thereof.

In such a state, an abnormal sound is produced each time the film is rotated and in some cases, the film may be buckled in that portion to thereby cause the damaging of the film. According to my studies, the abnormal sound of the film became remarkable when the difference between the heights of the sliding surfaces of the rib and the regulating member relative to the inner surface of the film was 1.0 mm or greater. Accordingly, it is preferable that the difference between the heights of the sliding surface of the rub relative to the inner surface of the film and the sliding surface of the regulating member relative to the inner surface of the film be 1.0 mm or less.

(Second Embodiment)

Figure 5:
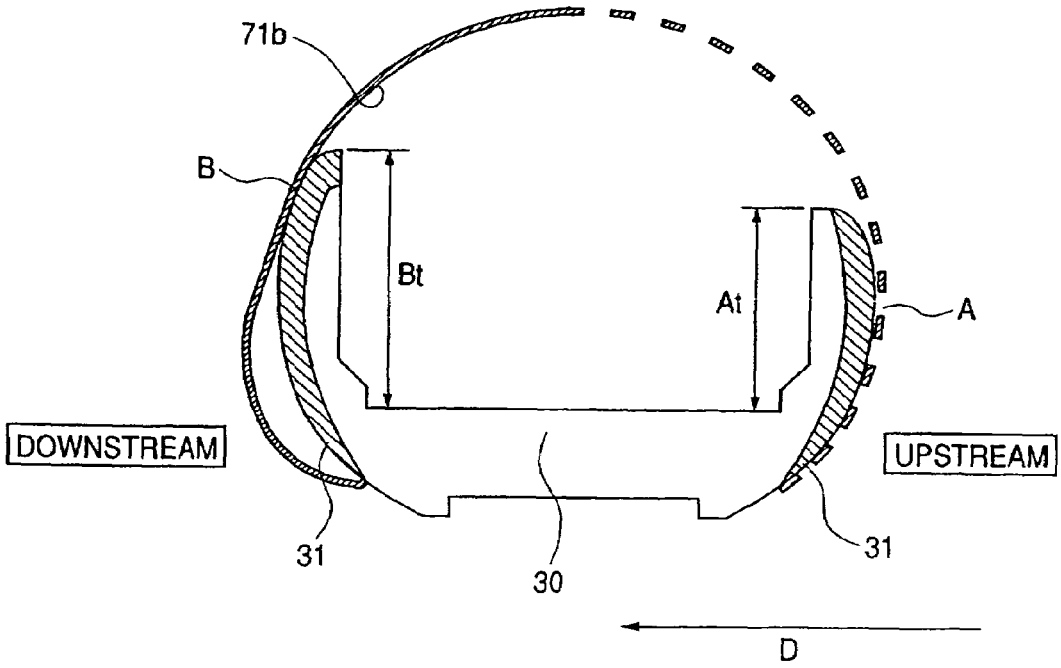
FIG. 5 shows the relations between the contour of a film guide in a second embodiment of the present invention and the contour of a regulating member for regulating the end portions of film.
Figure 6:
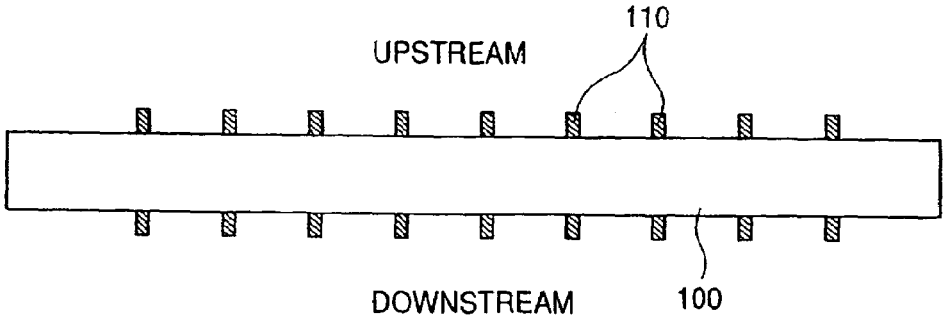
FIG. 6 is a view of the film guide as it is seen from a fixing nip surface side.
Figure 7:
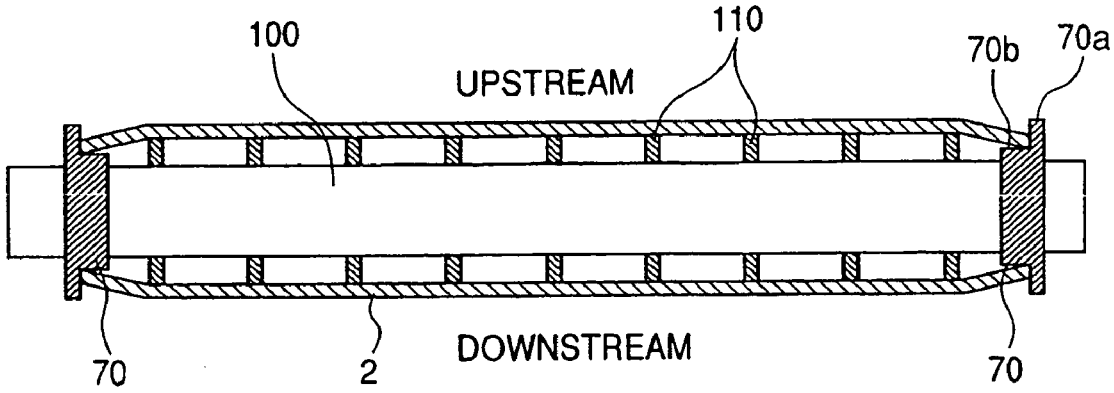
FIG. 7 is a cross-sectional view showing a construction in which film and a regulating member are combined with the film guide as it is seen from the fixing nip surface side.
Figure 8:
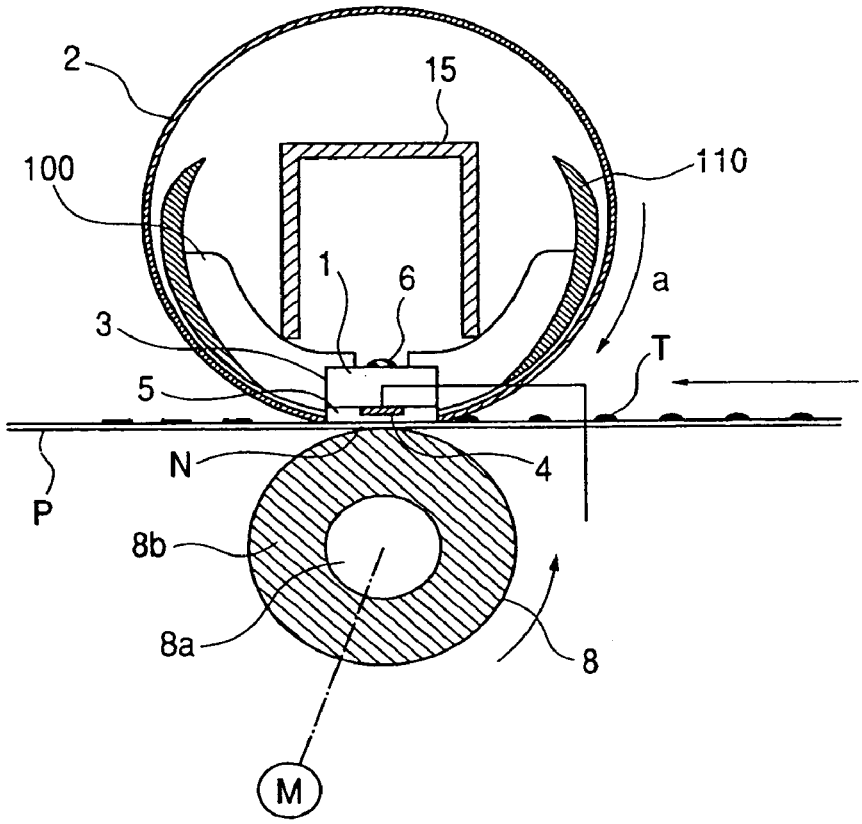
FIG. 8 is a side cross-sectional view of a conventional image heating apparatus.
Figure 9:
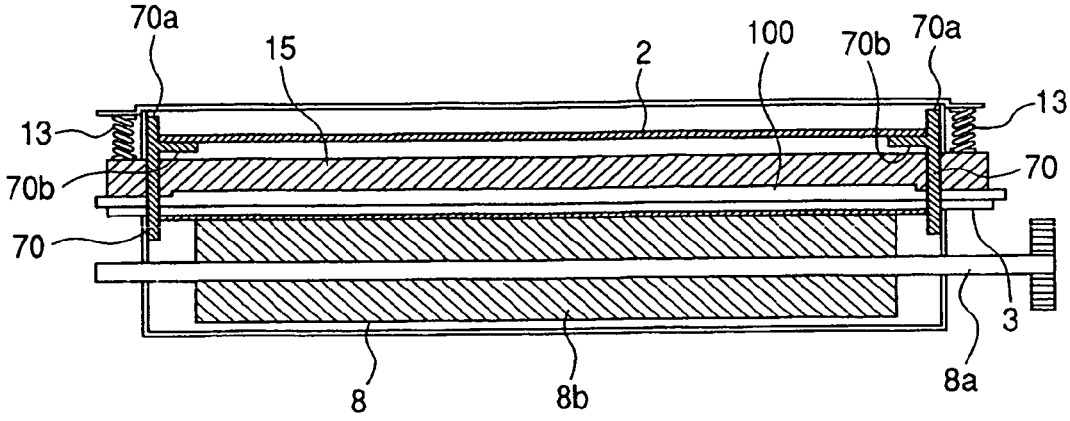
FIG. 9 is a front cross-sectional view of the conventional image heating apparatus.
Figure 10:
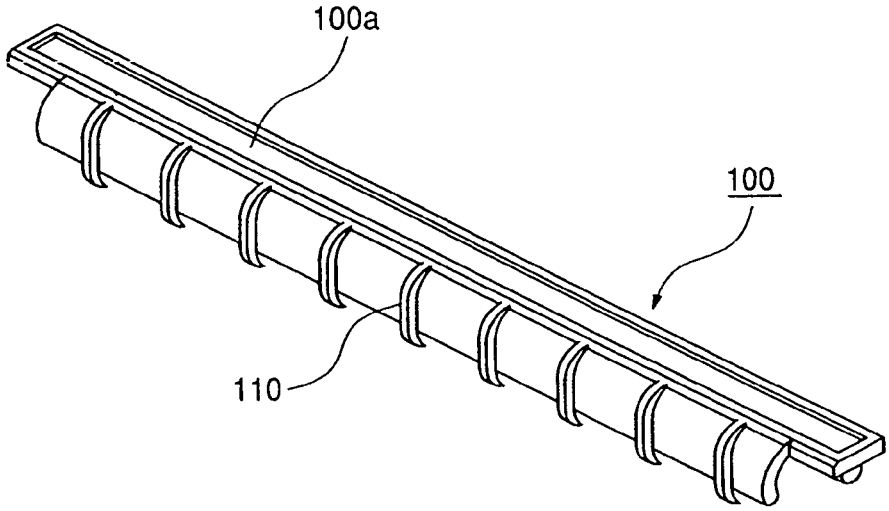
FIG. 10 is a downward perspective model view of a conventional film guide.

FIG. 5 is a transverse-cross-sectional view showing a film guide 30 and the sliding surface 71*b* of a regulating member 71 relative to the inner surface of the film in the present embodiment in overlapped relationship with each other.

The sliding surface 71*b* of the regulating member 71 relative to the inner surface of the film in the present embodiment, as shown in FIG. 5, is of a substantially circular shape on the upstream side of the nip portion N with respect to the direction of rotation of the film, whereas it has a convex portion near the nip portion N on the downstream side. The circumferential length of the sliding surface 71*b* of the regulating member 71 relative to the inner surface of the film has a very slight clearance relative to but is substantially the same as the inner circumferential length of the film, and the film during the rotating movement thereof assumes a shape substantially similar to the shape of the sliding surface 71*b* of the regulating member 71. Again in the case of the present embodiment, the shapes of ribs and the sliding portion 71*b* of the regulating member 71 are set such that the contour of all of a plurality of ribs 31 provided along the lengthwise direction of the film guide 30 upstream of the nip portion is inside the contour of the sliding portion 71*b* of the regulating member 71.

That is, when the regulating member 71 in the present embodiment is used, the film assumes such a shape that it protrudes toward the downstream side during the rotating movement thereof. In the case of the regulating member 7 having a sliding surface 7*b* substantially circular and symmetrical upstream and downstream of the nip as in the first embodiment, the shape of the film during the rotating movement thereof also becomes substantially symmetrical upstream and downstream of the nip.

When the film is rotatively moved in the shape substantially symmetrical upstream and downstream of the nip as described above, the direction of movement of the film at the terminal portion of the nip with respect to the direction of rotation changes at a sharp angle from the transport direction of the material to be heated and therefore, the material to be heated, when discharged from the nip, is relatively immediately separated from the film.

In contrast, in the rotating movement shape in which the film protrudes immediately after the nip as in the present embodiment, the direction of movement of the film is substantially the same as the transport direction of the material to be heated still after it has passed the nip position. Accordingly, the separation of the material to be heated from the film takes place more downstream than in the case of the shape circular and symmetrical upstream and downstream of the nip.

The material to be heated and the film heat by the nip are small in heat capacity and therefore are suddenly cooled when they pass the nip, but the degree of cooling becomes greater as they become more distant from the nip. Accordingly, if the separating point of the material to be heated from the film becomes more downstream, use can be more effectively used of the advantage which is a feature of the film heating process that cooling and separation can be effected with the fixing point and the separating point being set discretely from each other.

Specifically, when the material to be heated is a recording material bearing a toner image thereon, the more downstream is effected separation as described above, the recording material is separated from the film after the toner image has been more sufficiently cooled and fixed and therefore, it becomes difficult for offset to occur.

Now, in a case where as in the present embodiment, the film assumes a shape in which it protrudes toward the downstream side, as compared with the film shape substantially symmetrical upstream and downstream of the nip, to keep a clearance between the regulating member and the film, it is of course necessary to decrease the moving distance of the film on the upstream side by an amount corresponding to the downstream side from the nip portion being made convex, as by making the curvature of the sliding surface of the regulating member relative to the inner surface of the film upstream of the nip portion great. When seen in the cross-sectional view of FIG. 5, as the film moving distance B on the downstream side increases, the film moving distance A on the upstream side decreases, and the relation that B>A is brought about.

When a regulating member of such a shape is used, the center of figure of the shape of the film deviates toward the downstream side as compared with a cases where the regulating member of a shape symmetrical upstream and downstream is used.

Unless the shape of the ribs on the upstream side of the nip and the shape of the regulating member are sufficiently taken into consideration correspondingly to the center of figure of the film thus deviating toward the downstream side, the tension of the film by the ribs on the upstream side will become very strong and the damaging of the film will be readily caused.

In the present embodiment, setting is effected such that even if use is made of the regulating member having a convex sliding surface 71*b* on the downstream side, a height enough for the ribs upstream of the nip to sufficiently function as the sliding surface of the film and yet, the sliding surface 71*b* of the regulating member relative to the inner surface of the film covers the ribs in the cross-sectional shape thereof to thereby prevent the film from strongly frictionally contacting with the ribs. Specifically, when as shown in FIG. 5, the height of the film guide in a direction-orthogonal to the transport direction of the material to be heated is defined as At on the upstream side and as Bt on the downstream side, the height on the upstream side is made lower than the height on the downstream side, that is, Bt>At, to thereby secure a clearance corresponding to an amount by which the downstream side protrudes in the rotatively moving shape of the film in this portion.

The sliding surface 71*b* of the regulating member upstream of the nip portion is set so as to completely cover the sliding surface relative to the inner surface of the film which is formed such shape of the film guide and the ribs in the cross-section thereof. Thereby, even if the sliding surface 71*b* of the regulating member downstream of the nip portion is made convex, it never happens that the film is too much tensioned between the ribs on the upstream side and the regulating member, and offset can be made good without the damaging of the film being caused.

The present invention is not restricted to the above-described embodiments, but covers modifications within the technical idea thereof.

What is claimed is:

1. An image heating apparatus for heating an image formed on a recording material, comprising:

a flexible sleeve member;

a guide member provided in said flexible sleeve member, for guiding a direction of rotation of said flexible sleeve member;

a regulating member provided opposed to an end surface of said sleeve member, for regulating movement of said sleeve member in a generatrix direction, said regulating member having a flange portion opposed to the end surface of said sleeve member and a sliding portion opposed to an inner surface of an end portion of said sleeve member;

a rotatable member contacting with an outer surface of said sleeve member;

a nip portion formed by contacting said flexible sleeve member with said rotatable member, for heating the image formed on the recording material, wherein a plurality of ribs are provided on said guide member at least at a portion upstream of said nip portion with respect the direction of rotation of said sleeve member, and wherein a contour of the sliding portion of said regulating member is larger than a contour of said plurality of ribs.

2. An image heating apparatus according to claim 1, wherein the contour of said sliding portion of said regulating member downstream of the nip portion with respect to the direction of rotation of said sleeve member is substantially symmetrical with the contour of the sliding portion of said regulating member upstream of the nip portion.

3. An image heating apparatus according to claim 1, wherein there is a convex portion on said sliding portion of said regulating member downstream of the nip portion with respect to the direction of rotation of said sleeve member.

4. An image heating apparatus according to claim 3, wherein the height of said guide member on the upstream side of the nip portion with respect to the direction of rotation of said sleeve member is lower than the height thereof on the downstream side.

5. An image heating apparatus according to claim 1, further comprising a heating member held on a surface of said guide member adjacent to the nip portion.

* * * * *

UNITED STATES PATENT AND TRADEMARK OFFICE

CERTIFICATE OF CORRECTION

PATENT NO. : 6,993,279 B2
APPLICATION NO. : 10/800777
DATED : January 31, 2006
INVENTOR(S) : Daizo Fukuzawa et al.

It is certified that error appears in the above-identified patent and that said Letters Patent is hereby corrected as shown below:

COLUMN 2:
Line 64, "into" should be deleted.

COLUMN 7:
Line 5, "elongate" should read --elongated--.
Line 31, "lineal" should read --linear--.

COLUMN 8:
Line 30, "into" should be deleted.

COLUMN 9:
Line 41, "s" should read --as--.
Line 51, "lower" should read --low--.

COLUMN 10:
Line 61, "used" should read --made--.
Line 67, "is effected separation" should read --separation is effected--.

COLUMN 12:
Line 1, "much" should be deleted.

Signed and Sealed this

Fifteenth Day of August, 2006

JON W. DUDAS
*Director of the United States Patent and Trademark Office*